US006296569B1

(12) United States Patent
Congello, Jr.

(10) Patent No.: US 6,296,569 B1
(45) Date of Patent: Oct. 2, 2001

(54) FRACTIONAL DENOMINATION GAMING SYSTEM AND METHOD OF PLAYING

(76) Inventor: Philip Congello, Jr., 55 Kellers Farm Rd., Easton, CT (US) 06612

( * ) Notice: Subject to any disclaimer, the term of this patent is extended or adjusted under 35 U.S.C. 154(b) by 0 days.

(21) Appl. No.: 09/690,229

(22) Filed: Oct. 17, 2000

Related U.S. Application Data

(60) Provisional application No. 60/183,463, filed on Feb. 18, 2000.

(51) Int. Cl.[7] ..... A63F 13/00

(52) U.S. Cl. ..... 463/17; 463/16; 463/29; 273/138.1; 273/139; 283/901

(58) Field of Search ..... 273/138.1, 139, 273/269; 463/17, 13, 18, 16, 29; 283/901; 379/93.13; 705/1, 14

(56) References Cited

U.S. PATENT DOCUMENTS 4,993,714 * 2/1991 Golightly ..... 273/138 A
5,772,510 * 6/1998 Roberts ..... 463/17
5,791,990 * 8/1998 Schroeder et al. ..... 463/17
5,851,010 * 12/1998 Feinberg ..... 273/274
5,855,514 * 1/1999 Kamille ..... 463/17
5,944,606 * 8/1999 Gerow ..... 463/27
5,949,042 * 9/1999 Dietz, II et al. ..... 235/375
6,000,725 * 12/1999 Nicolosi et al. ..... 283/67
6,024,641 * 2/2000 Sarno ..... 463/17
6,056,289 * 5/2000 Clapper, Jr. ..... 273/138.2
6,080,062 * 6/2000 Olson ..... 463/42
6,086,477 * 7/2000 Walker et al. ..... 463/17
6,146,272 * 11/2000 Walker et al. ..... 463/17
6,186,502 * 2/2001 Perkins ..... 273/138.1

* cited by examiner

*Primary Examiner*—Steven Wong
*Assistant Examiner*—Dolores R. Collins
(74) *Attorney, Agent, or Firm*—Levisohn, Lerner, Berger & Langsam

(57) ABSTRACT

A fractional denomination on-line gaming system and method of playing for use in all lottery, commercial game, promotional and other game applications. The preferred method of playing allows a consumer to purchase a fractional denomination share of a full unit game ticket, in an amount equal to the change the customer would have received back from any purchase of goods or services from a retailer authorized to offer the game. The method of playing includes a gaming system to exchange a customer's change for a fractional denomination game ticket for a chance at winning a prize. Players holding winning tickets will each receive a proportion of the overall prize based on the value of their wager relative to the total amount wagered by all winning tickets. Fractional denomination game tickets may play at equal odds of winning a prize or at weighted odds based on the fractional denomination share of a full unit game ticket entry. The lottery sponsor will determine the winning numbers according to the rules of the particular game. The game can incorporate the existing equipment of the lottery sponsor and requires programming and software modifications for processing fractional denomination game tickets. The ticket is printed in a format that facilitates a fractional denomination game ticket. The invention and method of playing can be adapted for use in other games of chance, games of skill and other gaming categories.

18 Claims, 3 Drawing Sheets

FRACTIONAL DENOMINATION GAMING SYSTEM AND METHOD OF PLAYING

This application claims the benefit of Provisional No. 60/183,463 filed Feb. 18, 2000.

FIELD OF THE INVENTION

This patent relates to the field of gaming systems, and more particularly, to a system that creates a new on-line game and method of playing that allows consumers to purchase fractional denomination shares of full unit game tickets, in amounts equal to the change (coins) customers would have received back from their purchases of goods and services from retailers authorized to offer the game. Upon a player's request, the gaming system exchanges his/her change from any purchase, for a fractional denomination game ticket in any amount up to $0.99 for a chance at winning a prize on a pro-rata basis.

BACKGROUND OF THE INVENTION

Many states and countries currently sponsor on-line lottery and lottery-type games. Typically, the larger jackpot games are LOTTO and multi-state POWERBALL, whereby consumers have a chance of winning a jackpot by matching six or seven numbers out of a possible set of 40 or 50 numbers drawn by the lottery sponsor on a weekly or biweekly basis. Smaller jackpot games include PICK 3 and PICK 4, and involve matching three or four numbers from a set of 10 numbers drawn daily. State-run on-line games are sold to consumers in full unit, fixed-denomination tickets (usually $1), play at equal odds, and share jackpots equally across all winning tickets. There has been no experimentation, however, with methods that allow consumers to purchase on-line game tickets in fractional denominations of any amount up to $0.99, and that share jackpots on a pro-rata basis.

Although state-sponsored games of chance have become more popular over the years, there are periods of stagnation in their revenue growth, which can be directly attributable to the level of public interest and enthusiasm for the games at any particular point in time. In order to maintain the public's enthusiasm for lottery-type games, the states must constantly search for new methods of play to entice consumers to play on-line games.

Most efforts to increase enthusiasm for lotteries have centered on creating games that feature bigger jackpots, vary the number matching combinations or update the promotion "themes". No experimentation has been done with methods that achieve "gaming excitement" by offering players the prospect of conveniently wagering their "small change" for a chance at winning a big jackpot worth thousands of dollars.

Because this method allows consumers to exchange their change for game tickets in an amount they find most convenient at the time of purchase, the game described herein will capture new players, re-capture lapsed players and increase revenues for state-sponsored lotteries.

In addition, potential players will appreciate the game's convenience of converting change into fractional game tickets because research shows that most Americans genuinely dislike handling and counting loose coins.

In fact, most Americans would rather accept a lesser amount of money in bills than more money in loose change; 68% would choose a $50 bill over $55 in coins. Seventy five percent stockpile their loose coins at home, rather than make the effort to handle change during transactions. Over 54% of consumers don't take the time to count their change after a purchase. American's dislike for their own change has now carried over to dislike for other people's loose change. Nearly 1 in 4 report annoyance when someone holds up the checkout line in order to search for, and pay with exact change.

In view of the foregoing, it can be seen that there is a need for a new on-line game that will appeal to players and increase state revenues with a method that is convenient, easy to understand, and can be incorporated within the current state-sponsored on-line terminal and infrastructure systems.

OBJECTS AND SUMMARY OF THE INVENTION

It is an object of the invention to provide an on-line gaming system and a method of playing that allows consumers to purchase fractional denomination shares of full unit game tickets, in amounts equal to the change (coins) customers would have received back from their purchases of goods and services from retailers authorized to offer the game.

It is another object of this invention to integrate with existing on-line technology so that consumers can conveniently exchange their change (coins) from any purchase for a fractional denomination share of a full unit game ticket (up to $0.99) for a chance to win a prize.

Still another object of the invention is to provide a game that offers fractional denomination ticket holders equal odds of winning a particular prize.

Yet another object of this invention is to provide a game whereby winning ticket holders share prizes proportionately based upon the winning tickets' relative fractional values.

Still another object of the invention is to provide a game, which plays on the lottery sponsor's existing on-line equipment, and with proprietary or open architecture software systems, whether mainframe or PC based, thereby simplifying implementation and day-to-day operations.

In summary, this invention relates to the field of gaming systems, and is directed to an on-line game of chance and a method of playing for use in all lottery applications, commercial game applications, and promotional and other game applications. The method of playing allows a consumer to purchase a fractional denomination share of a full unit game ticket, in an amount equal to the change the customer would have received back from any purchase of goods or services from a retailer authorized to offer the game. Upon a player's request, the gaming system exchanges his/her change (coins) for a fractional denomination game ticket in any amount up to $0.99 for a chance at winning a prize on a pro-rata basis. In one method of play, if a consumer buys a newspaper for $0.25 from an authorized retailer and pays for the paper with $1, this invention will allow the consumer the option of purchasing a fractional denomination share of a full unit game ticket in the amount of the $0.75 that would have been returned in change (coins). The lottery retailer processes the request and issues a quick-pick, $75/100^{th}$ fractional share of a full unit game ticket. Fractional denomination game tickets may play at equal odds of winning a prize or at weighted odds based on the fractional denomination share of a full unit game ticket entry. The lottery sponsor will randomly draw the winning numbers. Game winners share prizes proportionately based upon the winning tickets' relative fractional values. For example, players holding winning tickets will each receive a proportion of the overall prize based on the value of their wager relative to the total amount wagered by all winning tickets. The game can incorporate the existing equipment of the lottery sponsor for selecting quick-pick numbers, printing tickets, drawing winners and requires proprietary software programs, or the modification of existing software for recording, processing and determining prizes. The ticket is printed in a format that facilitates a fractional denomination ticket game, and includes a randomly generated quick-pick number, amount wagered, play date and security codes. The invention and method of play can be adapted for use in other games of chance, games of skill and other related gaming categories.

DETAILED DESCRIPTION OF THE INVENTION

This invention is directed to an on-line game in which players' wages are placed in a common pool and divided among the selected winners and the lottery sponsor in accordance with the rules of the game. In this game, players purchase fractional denomination shares of full unit game tickets in an amount equal to the change the customer would have received back from the purchase of goods or services from a retailer authorized to offer the game. The gaming system can accept a player's change from any retail purchase in exchange for a fractional denomination game ticket in any amount up to $0.99, for a chance at winning a prize on a pro-rata basis. For example, if a player buys a newspaper for $0.25 from an authorized retailer and pays for it with a dollar bill, this invention will allow the player the option of accepting a $75/100^{th}$ fractional share of a full unit game ticket instead of $0.75 in coins. This game can work with the existing equipment used by lottery sponsors.

Figure 1:
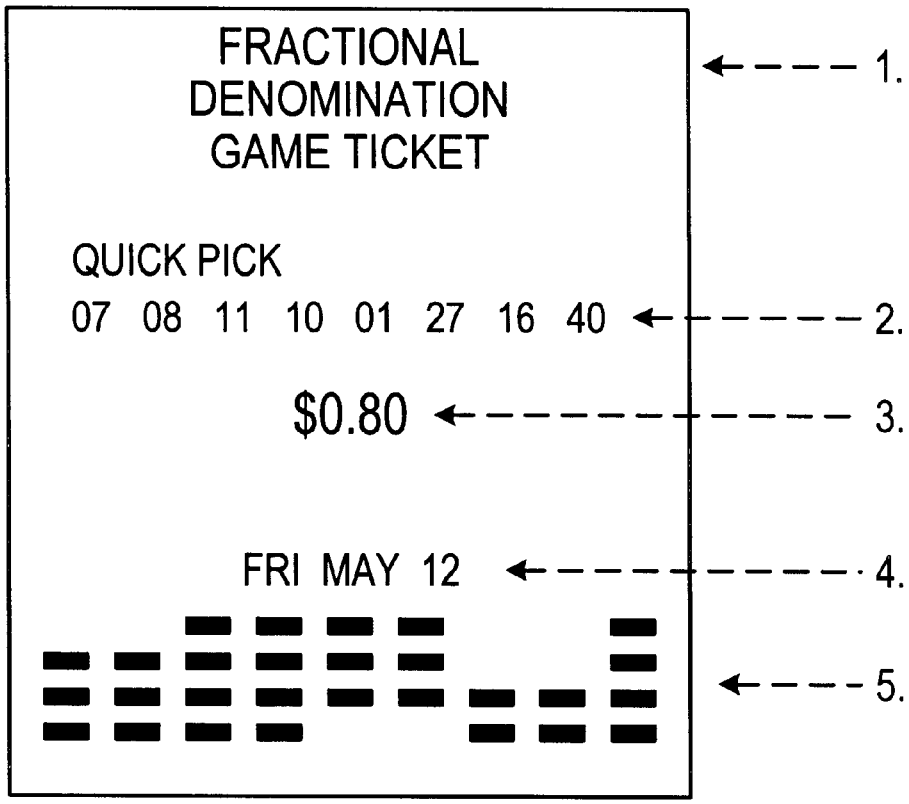
FIG. 1 sample fractional denomination game ticket.

The invention will be further described with reference to the drawing figures. FIG. 1 shows a sample ticket (1) having the ticket's randomly generated, quick-pick 8-digit number (2), fractional wager (3), and date of game (4). The bar codes (5) provide security measures against counterfeiting and allows for machine reading and validation of tickets. Preferably, winning of prizes using the ticket in FIG. 1 is accomplished by matching the ticket selected by the lottery sponsor, all eight numbers in the exact order drawn. The lottery sponsor will draw from the pool of all tickets sold for a particular game to guarantee winners. Winning criteria is not limited to matching all numbers in the order drawn, nor to drawing from the pool of tickets sold for a particular game, but can be modified at the discretion of the lottery sponsor.

In an alternative format to guaranteeing winners, the lottery sponsor can randomly choose a set of numbers for each game. This could result in having one, two or more or no winners for a particular game.

This invention uses a quick-pick, random number generator for creating the ticket shown in FIG. 1, but can offer the option of allowing players to select their own numbers by marking play slips.

Figure 2:
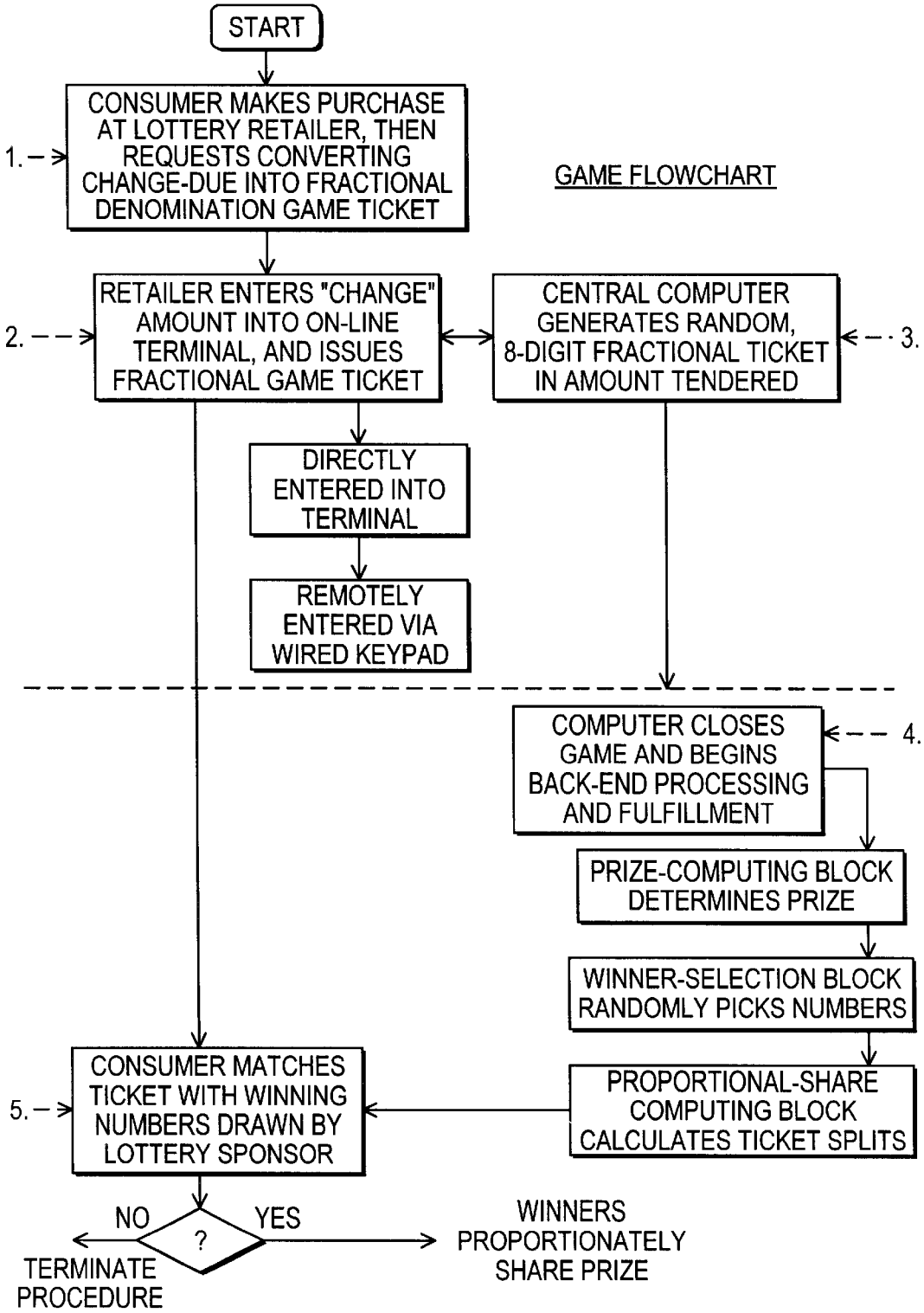
FIG. 2 flow chart depicting game steps

FIG. 2 shows a flow chart depicting the method of playing starting with the first step of the consumer requesting a fractional denomination game ticket by exchanging his/her change after a typical purchase at an authorized retailer (1), and the subsequent steps of the retailer entering the amount of change that would have been returned, as the ticket's purchase price, either directly or remotely into the online terminal to issue ticket (2), and lottery sponsors' central computers processing and generating an 8-digit fractional ticket (3). After game stops selling tickets and "closes" to draw winners, the central computers begin back-end processing and fulfillment (4), including prize computing, winner selection and proportional share calculations. Lottery sponsors may draw winners from the pool of all tickets sold for a particular game or from a random number generator. (SEE FIG. 3). Players match ticket with winning numbers drawn by lottery sponsor (5). The invention is not limited to manned on-line terminal operations, but can be modified to include self-service ticketing equipment.

Figure 3:
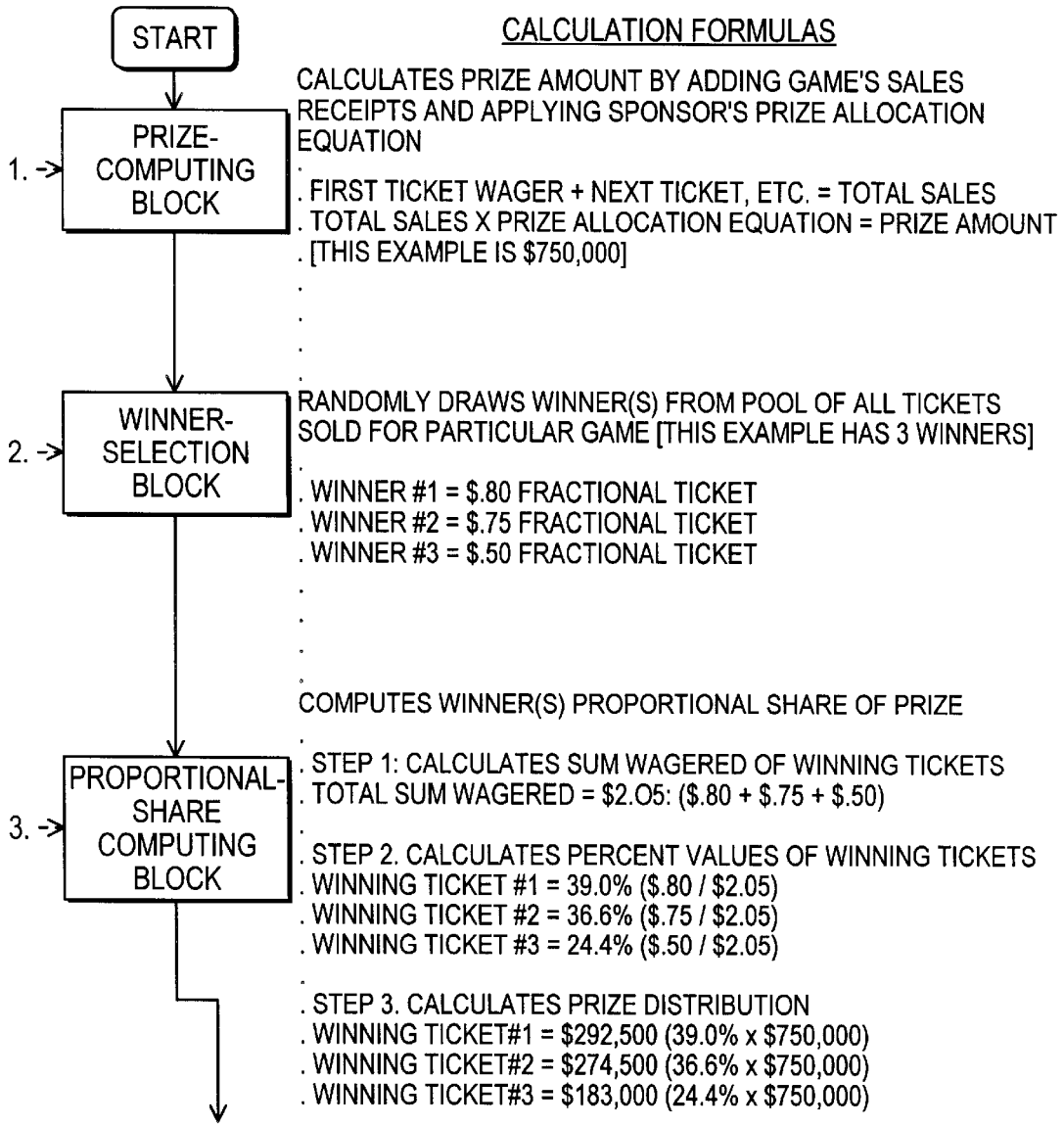
FIG. 3 flow chart depicting computing blocks

FIG. 3 shows a detailed view of the prize-computing block (1), winner-selection block (2) and proportional-share computing block (3). In this instance, if a game's sales receipts determine a $750,000 jackpot, and the lottery sponsor selects three winners, the proportional-share computing block will calculate how the prize will be awarded among the winning ticket holders on a pro-rata basis. This is accomplished first by the proportional-share computing block adding the fractional denomination amounts of each of the winning tickets to determine the total sum wagered (i.e. $0.80+$0.75+$0.50 equals $2.05).

The next step is to determine the percent values of the individual winning tickets by dividing their fractional denominations by the total sum wagered. In this example, the percent values equal 39.0%, 36.6% and 24.4% respectively.

Then, the proportional-share computing block will determine prize distribution among the winners by multiplying the $750,000 jackpot by each of the winning tickets' percent values. The pro-rata dollar shares of this sample jackpot are equal to $292,500, $274,500, and $183,000 respectively.

The invention is capable of being incorporated within existing equipment currently in use with state-sponsored lotteries. This equipment includes for example, a secure network of on-line terminals, proprietary and open architecture software systems, random number generating equipment, and ticket printing mechanisms. Software modifications are required for the invention's computing blocks and for an optional remote keypad input device that can be located near retailers' cash registers for convenience. The precise manner in which the winner numbers are selected can be tailored to meet the objectives of the lottery sponsor.

While this invention has been described as having a preferred design, it is understood that the invention is capable of further modifications, uses and/or adaptations following in general the principle of the invention and including such departures from the present disclosure as come within the known or customary practice in the art to which it pertains and as may be applied to the central features hereinbefore set forth, and fall within the scope of the invention or the limits of the claims appended hereto.

For example, the invention is not limited to a stand-alone game application as described herein, but is capable of being incorporated within existing lottery and lottery-type games, such as LOTTO and multi-state games such as POWERBALL, so that players of these games are provided the additional option of purchasing fractional denomination game tickets along with the current option of purchasing fixed denomination, full unit tickets (usually in $1 increments). In the case of a single, fractional ticket winner, the proportional sharing of a jackpot is then based on the winning ticket's fractional denomination as a percent of a full ticket unit. For example, a single winner holding an $0.80 fractional ticket is entitled to an 80% share of the game's jackpot.

Yet another modification of this invention for either stand-alone or existing games, is to provide consumers the option of buying fractional denomination game tickets outright, rather than tying their purchase to the amount of change being returned from a retail transaction.

This would allow a player to deliberately purchase a $0.65 game ticket, or a $1.65 game ticket. The $1.65 game ticket is an example of an application that adds a fractional denomination to a fixed denomination, full unit ticket.

The invention can be applied to other games of chance besides on-line lotteries and raffles, and could include "instant win" lottery tickets, video lottery terminals, video poker games, slot machines, BINGO and KENO.

Still, the invention can be modified for Internet retail commerce so that after an electronic purchase is made, a consumer can "round-up" the purchase amount to the next whole dollar and buy an electronic fractional game ticket in the amount equal to the difference between the original purchase price and the next whole dollar. In this example, the method of play would accommodate payments by use of credit cards and debits cards.

The invention is also capable of further adaptations for games of skill and related pari-mutuel wagering, including thoroughbred, harness and dog racing and sports betting.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

What is claimed is:

1. A gaming system for games of chance and other games comprising:

a plurality of players with each wagering an amount that is any fractional denomination of the amount required to purchase a fixed denomination, full unit game entry, means to provide a fractional denomination entry record to each of said plurality of players who wager fractional amounts, and means to determine the prizes paid according to the fractional denomination wagered if the player is qualified as a winner.

2. A gaming system according to claim 1, wherein said game is limited to wagers comprising fractional denominations of full unit game entry.

3. A gaming system according to claim 1, wherein said game includes both fixed denomination full unit game entries.

4. A gaming system according to claim 1, wherein said system comprises means for recording the player's entry, such as a game ticket, which means are connected to a point of purchase location whereby a customer can purchase a fractional denomination share of a full unit game entry equal to the change the customer would have received from the purchase of goods or services from a retailer authorized to offer the game.

5. A gaming system according to claim 2, wherein said system comprises means for recording the player's entry, such as a game ticket, which means are connected to a point of purchase location whereby a customer can purchase a fractional denomination share of a full unit game.

6. A gaming system according to claim 3, wherein said system comprises means for recording the player's entry, such as a game ticket, which means are connected to a point of purchase location whereby a customer can purchase a fractional denomination share of a full unit game entry.

7. A gaming system according to claim 5, wherein said fractional denomination share of a full unit game entry is equal to the change the customer would have received from the purchase of goods or services from a retailer authorized to offer the game.

8. A gaming system according to claim 6, wherein said fractional denomination share of a full unit game entry is equal to the change the customer would have received from the purchase of goods or services from a retailer authorized to offer the game.

9. A gaming system according to claim 1, wherein the fractional denomination game entry plays at equal odds and has the same chance of winning a prize as a full unit game entry.

10. A gaming system according to claim 1, wherein the fractional denomination game entry plays at weighted odds of winning a prize based on the fractional denomination share of a full game entry.

11. A gaming system according to claim 1, wherein the amount of the prize awarded to a single prize winner is in the same proportion to the full prize amount as the prize winner's fractional denomination game entry is to a full unit game entry.

12. A gaming system according to claim 1, wherein the multiple prize winners each receive a proportion of the overall prize equal to the relative fractional value of their wager to the total amount wagered by all prize winners.

13. A gaming system according to claim 1, wherein said gaming system is conducted via an on-line terminal network.

14. A gaming system according to claim 1, wherein said gaming system is conducted via a PC-based network.

15. A gaming system according to claim 1, wherein said gaming system is conducted through a data transmission system.

16. A gaming system according to claim 1, wherein said gaming system is conducted via the Internet.

17. A gaming system according to claim 1, wherein said gaming system comprises means to record a player's fractional denomination game entry purchase by use of his/her credit/debit card, or other accepted method of payment.

18. A gaming system according to claim 1, wherein said gaming system comprises means to record a player's fractional denomination game entry purchase by use of his/her accepted non-cash method of payment.

* * * * *